US005542854A

United States Patent [19]

Bowen

[11] Patent Number: 5,542,854

[45] Date of Patent: Aug. 6, 1996

[54] EDGE CARD CONNECTOR WITH ALIGNMENT MEANS

[75] Inventor: David C. Bowen, Downers Grove, Ill.

[73] Assignee: Molex Incorporated, Lisle, Ill.

[21] Appl. No.: 373,816

[22] Filed: Jan. 17, 1995

[51] Int. Cl.[6] ..... H01R 13/62

[52] U.S. Cl. ..... 439/157; 439/377

[58] Field of Search ..... 439/152–160, 439/372, 374, 377

[56] References Cited

U.S. PATENT DOCUMENTS

| | | | |
|---|---|---|---|
| 4,477,138 | 10/1984 | Andrews, Jr. et al. | 339/65 |
| 4,898,540 | 2/1990 | Saito | 439/153 |
| 4,990,097 | 2/1991 | Billman et al. | 439/160 |
| 5,074,800 | 12/1991 | Sasao et al. | 439/157 |
| 5,106,315 | 4/1992 | Billman et al. | 439/160 |
| 5,163,847 | 11/1992 | Regnier | 439/157 |
| 5,167,517 | 12/1992 | Long | 439/160 |
| 5,211,568 | 5/1993 | Yamada et al. | 439/157 |
| 5,302,133 | 4/1994 | Tondreault | 439/157 |
| 5,429,523 | 7/1995 | Tondreault | 439/157 |
| 5,443,394 | 8/1995 | Billman et al. | 439/157 |

*Primary Examiner*—David L. Pirlot
*Attorney, Agent, or Firm*—Charles S. Cohen

[57] ABSTRACT

A connector for an edge card includes a card slot having a plurality of contact terminals disposed in a predetermined spacing. The connector also includes two latch/eject members pivotally mounted to the connector at the ends thereof in alignment with the connector card slot. The latch/eject members include an alignment surface positioned opposite the end edges of an edge card during insertion and the alignment surfaces are further positioned on the latch/eject members above an ejection surface such that the contact area between the connector housing terminals and the circuit card lies between the ejection and alignment surfaces. The alignment surface is a surface of potential revolution.

20 Claims, 5 Drawing Sheets

115
100
208
106
110
104
210
200
201
102
117
216
204
214
H1
218
108
240
10
40
28
34
30
20
14
18
23
16
12
38
L
28
242
42
36
32
38

EDGE CARD CONNECTOR WITH ALIGNMENT MEANS

BACKGROUND OF THE INVENTION

The present invention relates generally to edge card connectors, and more particularly, to an edge card connector having an edge card alignment mechanism which assists in and maintains the alignment of the edge card with terminals in the card slot of a connector during insertion.

Circuit, or edge card, connectors have been developed for computers to provide connections between main computer printed circuit boards, commonly referred to in the art as "mother" boards, and secondary electronic circuits contained on smaller printed circuit boards, commonly referred to in the art as "daughter" boards. These secondary circuits may be added to computers or other electronic devices during or after the initial manufacture thereof to enhance, improve or alter the performance thereof. They may be added by a professional electronic technician or a relatively unskilled computer user.

Space on the mother boards of computers is at a premium. Consumers prefer smaller electronic devices and, therefore, when assembly components, such as daughter boards, are spaced closer together on the mother board, the overall device may become more compact and more desirable to the consumer.

A number of different known connectors are intended for permanent installation on a computer mother board and provide a connection between circuitry on the mother board and various daughter boards. Daughter boards are often descriptively referred to in the art as "edge cards," because typically one edge of the card contains a plurality of electrical contacts or contact pads that extend laterally along the edge and provide the point of operative electrical connection between the edge card circuitry and the mother board circuitry. The bottom edge of the edge card is inserted into a card slot formed in the connector. The connector card slot includes a plurality of electrical contacts which lie in opposition to the edge card contacts. The connector contacts may extend down from the connector slot through the connector body and terminate in tail portions which are aligned with a series of openings on the mother board. The tails are received in the mother board openings and may be soldered to form electrically conductive connections between the mother board and the edge card connector. In the alternative, the tails may be surface mounted to the mother board as is known in the industry.

There are many edge card connectors existent in the art. A number of these connectors include mechanisms which secure, or "latch," the edge card in place within the connector after the insertion thereof in order to retain the edge card in a connective relationship in the connector. Other edge card connectors include ejection mechanisms which permit the user to easily eject the edge card from the connector slot after insertion to enable the computer user to easily remove the edge card from the connector. Still other edge card connectors include a combined latch-eject mechanism which performs both the latch and eject functions.

Alignment of the edge card contacts with the contact terminals of the connector card slot is extremely important. If an edge card is inserted into a connector card slot in a misaligned fashion, the contact adjacent the card slot may not establish a reliable connection with the contacts of the edge card or may result in incorrect connection between circuits on the edge card and the mother board. Positioning the edge card in the card slot after it has been inserted into the card slot may result in damage to the contact terminals in the card slot.

However, in an effort to further reduce the size of electronic components, connectors have been reduced in size and the pitch of connectors, i.e., the spacing between contact terminals, has become smaller. With a smaller pitch, the alignment of the edge card within the connector card slot becomes more critical. Where a small pitch is involved, misalignment during insertion of the edge card may result in damage to some of the circuitry on either the edge card or on the mother board on which the edge card connectors is mounted. In addition, it is sometimes desirable to permit edge cards to be inserted into the card slot while the connector is "hot." In other words, it may be desirable to be able to insert the edge card without turning off the power to the electronic component. At such time, it is especially important that each of the contacts pads of the edge card be properly aligned with the appropriate contacts of the connector in order to prevent any damage to fragile electronic circuits.

Some edge card connectors may include either projections formed within the card slot near the ends or in the center thereof which assist in orienting the edge card into its proper location in the card slot during insertion of the edge card into the edge card connector. Other connectors may incorporate alignment guides integrally molded as part of the connector housing which extend upwardly in the form of posts that define opposite ends of the card slot. These alignment guides are generally long and narrow members and may present problems when molding the housing from certain materials. In addition, some high temperature plastic materials from which the housings are molded are not particularly wear-resistant and repeated insertions and withdrawals of edge cards into and out of the card slot may cause substantial wear on the alignment guides and eventually may result in misalignment of the card.

Accordingly, a need exists for an edge card connector which incorporates an alignment mechanism into a latch/eject member. Such a structure is lacking in the art.

U.S. Pat. No. 4,898,540, issued Feb. 6, 1990, includes a rotatable latch/eject member that is rotatably mounted to an end of the edge card connector and includes a lower eject or push-up portion which engages the bottom part of a polarizing notch of an edge card connector. The lower portion provides a surface of the latch/eject member which bears against the edge card to provide a means for ejecting the edge card from the card slot.

U.S. Pat. No. 5,163,847 issued Nov. 17, 1992 to the assignee of the present application, describes an edge card connector assembly in which the card connector includes two rotatable latch members disposed at opposite ends of the connector and each of the latch/eject members having a pair of spaced projections extending therefrom which interengage a pair of recesses in the adjacent side edges of the circuit card. These projections move in serial order into and out of the recesses in response to pivoting of the latch/eject member. However, each of the latch/eject members of this connector assembly must be maintained in alignment in their open position at their maximum rotation to permit insertion of the circuit card. The circuit card or the edge card is not insertable at any angle of operation. This required alignment adds to the complexity of operation of such a connector.

Lastly, U.S. Pat. No. 1,167,517, issued Dec. 1, 1992 describes a latch/eject member for an edge card connector which includes an ear portion formed on the latch/eject member which extends into a polarizing slot of a edge card in order to act as a guide for insertion of the edge card. Although it identifies the proper orientation of the edge card within the connector card slot, it does so only with respect to the polarizing slot and only assists the user improperly placing the edge card in the proper orientation to be received by the housing card slot. The ear portion does not laterally align the card edges with respect to the card slot.

Accordingly, a need for an edge card connector having an alignment mechanism incorporated into a latch/eject member exists which is simple to operate and which effectively aligns the edge card at any position of the latch/eject member during insertion thereof.

SUMMARY OF THE INVENTION

The present invention is therefore directed to an edge card connector which offers significant advantages over the connectors described above and which provides a means for aligning the contact pads of the edge card with the terminals within the connector card slot during the insertion thereof, regardless of the position of the latch/eject members of the connector.

In one principal aspect, the present invention accomplishes these advantages by providing an edge card connector having a connector housing with an edge card slot extending along the longitudinal axis of the body between two sidewalls thereof, the connector housing having a latch/eject mechanism operatively connected to an end thereof, the latch/eject mechanism including at least one latch/eject member which is rotatable between first and second operative positions that correspond to respective positions wherein the edge card is latched into place in the connector card slot and wherein the edge card is at least partially ejected from the connector card slot, the latch/eject member including an edge card alignment surface formed thereon which extends toward the center of the connector card slot and contacts or abuts an edge of the edge card during insertion and which aligns the edge card longitudinally with respect to the connector housing contacts.

In yet another principal aspect of the present invention, the latch/eject members include an eject surface that engages the bottom edge of the edge card and which urges the edge card from the connector housing card slot when the latch/eject members are moved to their second operative position. The eject surfaces are spaced beneath and apart from the edge card alignment surfaces, such that the area in which electrical contact between the connector housing contact terminals and the contacts on the edge card lies between the alignment means and the eject surfaces of the latch/eject members.

In still another aspect of the present invention, the connector includes a latch/eject member rotatably mounted to the connector housing at one end thereof. The latch/eject member includes an alignment means having an arcuate surface projecting out from the latch/eject member body portion toward the connector housing card slot, the arcuate surface being defined by a surface of partial revolution having a constant radius which is coincident with the center of the axis of rotation of the latch/eject member.

These and other objects, features and advantages of the present invention will be clearly understood through a consideration of the following detailed description in which like reference numerals identify like parts.

BRIEF DESCRIPTION OF THE DRAWINGS

Reference will be frequently made to the attached drawings in which.

DETAILED DESCRIPTION OF THE PREFERRED EMBODIMENTS

Figure 1:
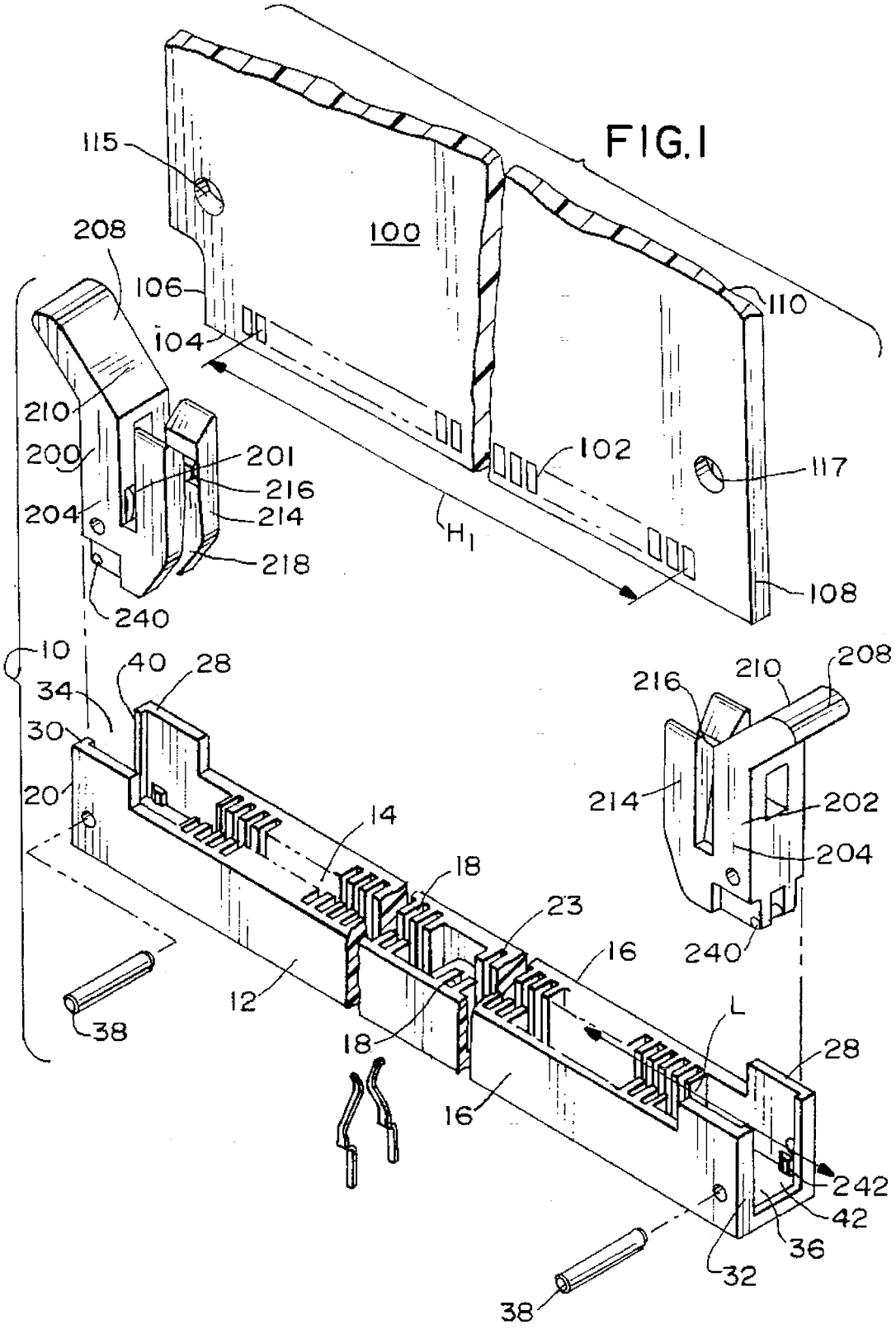
FIG. 1 is a exploded perspective view of an edge card connector constructed in accordance with the principals of the present invention.

FIG. 1 illustrates an edge card connector, generally indicated at 10, constructed in accordance with the principles of the present invention. The connector 10 includes an elongated, insulative housing 12 formed from a dielectric material and having an elongated circuit card slot 14 extending along the longitudinal axis, L, of the connector 10. The card slot 14 is defined by two opposing sidewalls 16 spaced apart from each other and extending generally parallel to each other for the length of the housing 12. The sidewalls 16 are of sufficient thickness to accommodate a plurality of contact-receiving cavities 18 disposed therein generally transverse to the card slot 14 and spaced apart from each other. These cavities 18 extend within the sidewall 16 between two opposing ends 20, 22 of the connector 10. The cavities 18 receive electrical terminals 23 which include contact portions 24 within the cavity and tail portions 26 which extend through the bottom 28 of the connector housing 12. These tail portions 26 are typically received in appropriate openings located on the primary circuit board or mother board (not shown). The terminals 23 are generally aligned within the connector housing cavities 18 so that the contact portions 24 define a contact area for contacting the circuit card 100 along a horizontal plane $H_1$ (FIG. 2) having a thickness approximately equal to the extent of contact between the contacts and the circuit card contact pads.

A circuit card, illustrated generally as a edge card 100, is received within the connector card slot 14 of the connector 10 and includes a plurality of electrical contacts, illustrated as contact pads 102, which extend adjacent the lower edge 104 of the circuit card 100 for a predetermined length between two opposing ends 106, 108 of the circuit card 100. The circuit card illustrated in FIG. 1 is of a "dual-readout" nature. That is, it includes electrical contact pads 102 on both circuit surfaces 109, 110 of the circuit card 100 which are not electrically interconnected together, but rather are termination points for separate circuit card circuits. The present invention is also equally effective when used with circuit cards of a "single readout" nature, wherein the contact pads on opposite sides of the circuit card are electrically connected and thus redundant.

As illustrated in FIG. 1, the circuit card 100 may typically include a polarizing slot 112 formed in one end 106 thereof which assists the user inserting the circuit card 100 into the connector card slot 14 in the proper orientation, as will be described in greater detail below. The circuit card 100 may also include openings 115, 117 formed therein and positioned generally adjacent the ends 106, 108 of the circuit card which provide surfaces for engagement by a suitable securement member of a latching mechanism, which may comprise either a manually actuatable member 200, 202 or a member which is fixed to the connector 10 at the ends 20, 22 thereof (not shown). The circuit card contact pads 102 are disposed generally in alignment with each other along a horizontal plane $H_2$ of the circuit card 100 and which may be parallel to the lower edge 104. When the circuit card 100 is fully inserted into the connector card slot 14, the horizontal planes $H_1$ and $H_2$ are generally coincident. The meeting of these two planes, $H_1$ and $H_2$ define a contact area between the circuit card contact pads 102 and the connector contacts 23.

The connector 10 also includes sidewall extension portions 28 located near the ends 20, 22 of the connector 10 that extend upwardly from the sidewalls 16. As illustrated in FIG. 1, these extensions 28 may be of the same thickness as the sidewalls 16. These sidewall extensions 28 terminate at endwalls 30, 32 of the connector, which extend inwardly from the sidewalls 16 as illustrated toward the axis L of the card slot 14. The sidewall extensions 28 and endwalls 30, 32 cooperate to define cavities 34, 36 at the ends 20, 22 of the connector which receive and support latch/eject members 200, 202 which are pivotally mounted to the connector 10 by a suitable securement means, illustrated as a roll pin 38. The endwalls 30, 32 of the connector housing 12 include openings 40, 42 aligned with the card slot 14 which permit limited pivotal movement of the latch/eject members 200, 202 out of the connector 10.

The connector latch/eject mechanism comprises latch/eject members 200, 202 formed in a suitable manner, such as by molding, from a durable plastic material such as nylon or the like. Each latch/eject member 200, 202 includes a body portion 204, a base portion 206 and an actuator portion 208. The actuator portion 208 extends generally upwardly from the body portion 204 to define a lever member 210 which may be manipulated by a user by applying a force thereto in order to pivot the latch/eject members 200, 202 about an axis of rotation C (centered at the center of roll pin 38) to partially eject the circuit card 100 from the connector card slot 14, as explained in greater detail below.

Figure 3:
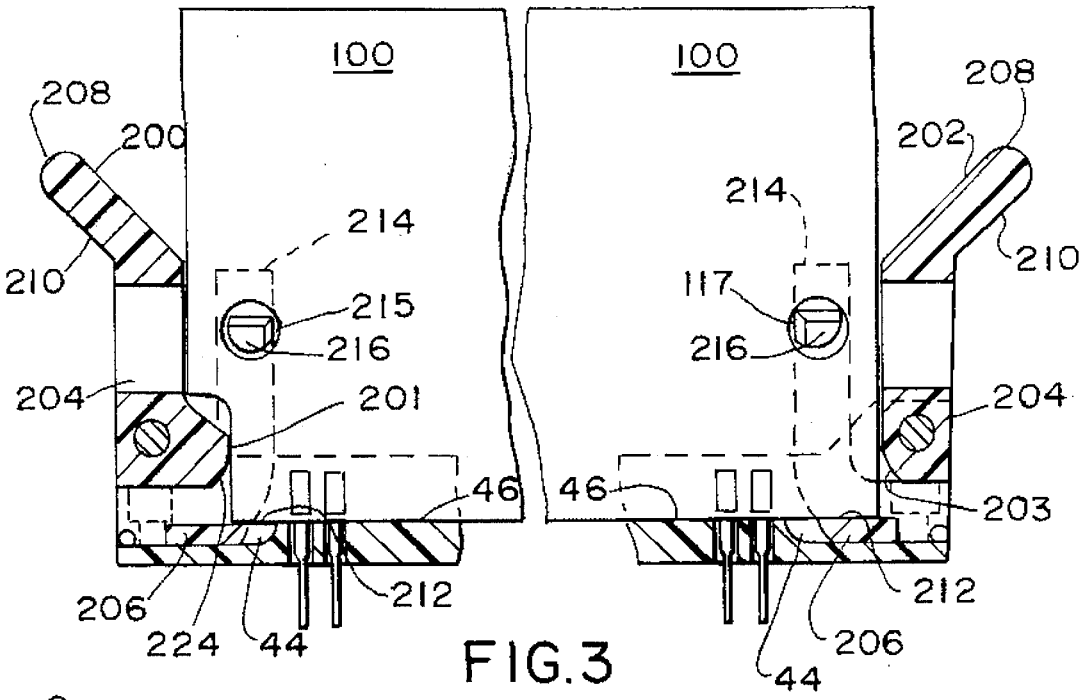
FIG. 3 is a sectional view of a circuit card fully inserted into the connector of FIG. 1 with the latch/eject members in a closed position latching the circuit card in place in the connectors.

With respect to the general structure of the latch/eject members 200, 202, it can be seen that the base portion 206 thereof extends generally away from the body portion 204 and into a recess 44 of the connector card slot 14 at the connector end cavities 34, 36 in a manner such that interior surfaces 212 of the base portion 206 are even with the bottom surface 46 of the connector card slot 14. As illustrated in FIG. 3, the circuit card lower edge 104 lies upon the latch/eject member base portion interior surfaces 212 when the circuit card 100 is fully inserted into the connector card slot 14 and when the latch/eject members 200, 202 are moved to their first operative position.

The latch/eject members may further include a latching mechanism, illustrated in the embodiment of FIGS. 1–4 as a pair of resilient latching arms 214 that extend from the body and base portions 204, 206 in an upstanding, cantilevered manner. Each latching arm 214 may include an inwardly facing projection 216, in the form of a boss, which is dimensioned to meet and engage appropriately positioned circuit card openings 115, 117 in order to retain the circuit card 100 within the connector 10. The thickness of these latching arms 214 may vary along their vertical extent as illustrated in FIG. 1, and thereby impart a desired degree of resiliency to the latching arms 214, especially near the body and base portions 204, 206, while still retaining a sufficient amount of inwardly directed gripping force to securely grip the circuit card 100 and maintain it in place within the connector 10. The latch/eject members may also include a means for indicating the extent of pivoting of the latch/eject member within the housing, such as detents 240, which extend outwardly from opposite sides of the latch/eject members. These detents 240 engage a raised surface 242 formed on the interior of the connector housing 12.

Figure 2:
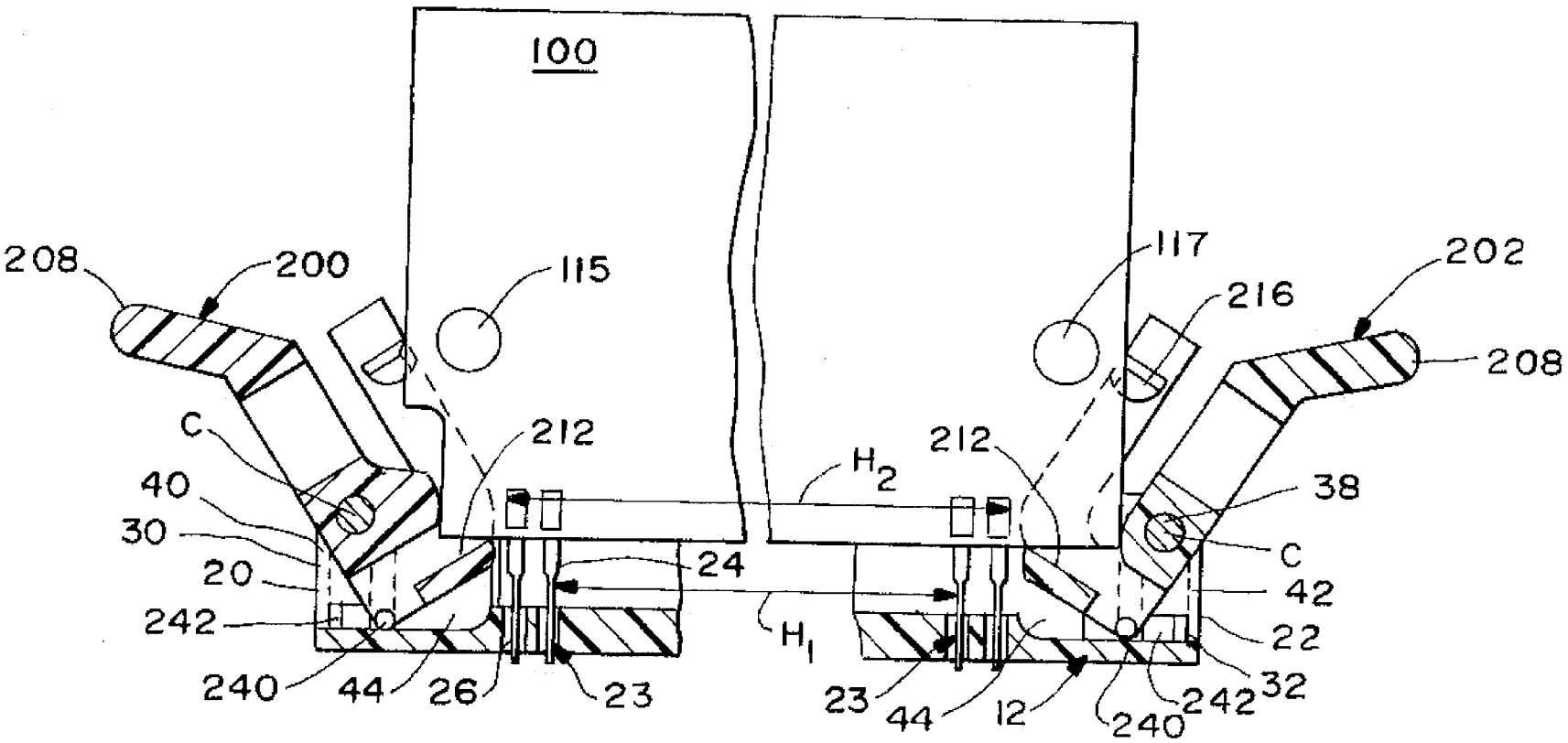
FIG. 2 is a sectional view of a circuit card partially inserted into the connector of FIG. 1 with the latch/eject members in the eject or open position, wherein the circuit card is ejected from the connector housing card slot.

The body and base portions 204, 206 cooperate to define a hollow card-receiving space 218 within each latch/eject member 200, 202 which is further defined by the upstanding latching arms 214. This hollow space 218 receives the opposing ends 106, 108 of the circuit card 100, as best illustrated in FIGS. 2 and 3, and particularly receives a portion of the lower edge 104 at the opposing ends 106, 108 of the circuit card 100. The portions of the circuit card 100 which are received by these spaces 218 may be continuous, as shown in the right of FIGS. 2 and 3, or they may include a polarizing slot 102 as shown in left of the FIGS. 2 and 3. The body portion 204 further includes an opening 220 disposed therein which receives the roll pin 38 by which the latch/eject members 200, 202 are pivotally connected to the connector 10.

In an important aspect of the present invention, each latch/eject member 200, 202 is provided with a means for horizontally aligning the circuit card 100 during all phases of insertion of the circuit card 100 into the card slot 14 by maintaining the ends 106, 108 of the circuit card 100 in longitudinal alignment with the connector card slot 14. This alignment means includes alignment surfaces 201, 203 formed on the latch/eject member body portions 204 thereof such that they confront, engage and guide the opposing end edges 118, 120 of the circuit card 100. Focusing specifically on the first latch/eject member 200, which is disposed in the connector housing cavity 34 at the first end 20 of the housing 12 which receives the first, or "polarized," end 106 of the circuit card 100, it can be seen that the alignment surface 201 includes an alignment lobe 224 formed as part of the latch/eject member body portion 204 which extends partially outwardly therefrom into the polarizing slot 112 of the circuit card 100.

This alignment surface 201 has a primarily arcuate contour and may be considered as a surface of partial revolution in the sense that the alignment surface 201 travels in an arc as the latch/eject member 200 pivots between the first and second operative positions illustrated in FIGS. 2 and 3. The contour of the alignment surface 201 may further be considered as a locus of tangent points between the latch/eject member alignment surface 201 and the opposing end edge 106 of the circuit card 100.

Figure 4:
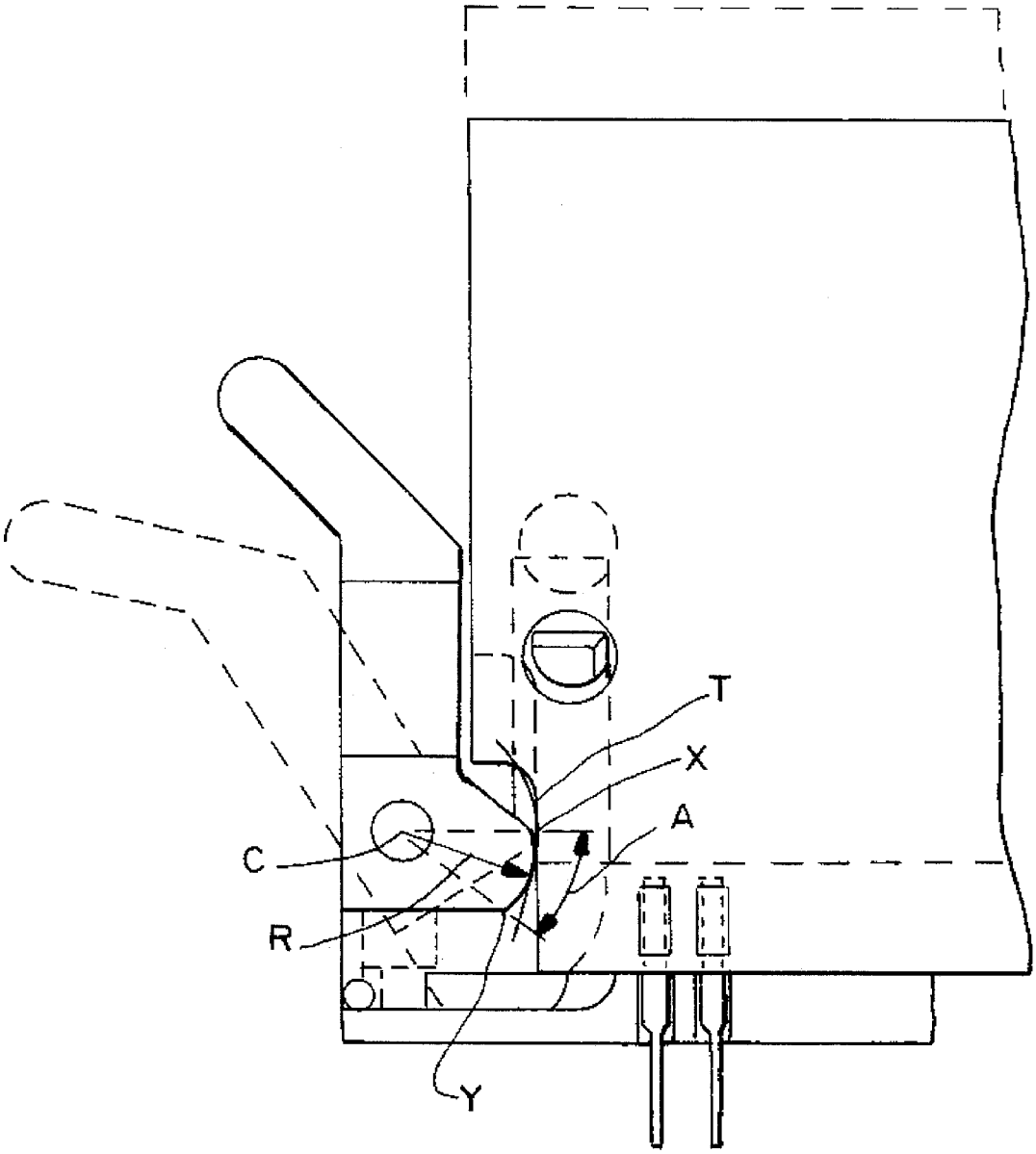
FIG. 4 is a diagrammatic view of the present invention showing the relationship of the latch/eject member components with respect to the connector housing and circuit card between the two operative positions of the latch/eject member.

As illustrated in the preferred embodiment of FIGS. 1–3 and as represented diagrammatically in FIG. 4, the alignment surface 201 may be partially circular in nature, wherein the contour of the alignment surface 201 includes a locus of tangent points, represented by the heavy line T in FIG. 4, each of which has a radius R of equal length extending from the center C of the roll pin 38. This alignment surface 201 has an arc length shown generally at A which extends between the two end points X & Y of the alignment lobe. In other words, the center of rotation of the alignment surface 201 during pivoting of the latch/eject member 200 is coincident with the center C of the roll pin 38. As such, the alignment surface 201 is constantly in contact with or immediately adjacent the end edge 106 of the circuit card 100 during insertion, regardless of the position of the latch/eject members 200.

As seen in FIGS. 2 and 3, the base portion 206 and the interior surfaces 212 of each latch/eject member serves as an eject surface that engages the lower edge 104 of the circuit card 100 and provides a reaction surface through which the circuit card 100 may be ejected from the connector 10 as illustrated primarily in FIG. 2. This eject surface 212 contacts the circuit card 100 during movement of the latch/eject members 200, 202 between their respective open and closed positions illustrated in FIGS. 2 and 3. The eject surfaces 212 are also spaced apart from the alignment surfaces 201, illustrated in the Figures as beneath the alignment surfaces, such that the contact area occurring between the connector contacts 24 and the circuit card contact pads 102 lies between the alignment surface 201 and the eject surfaces 212 and occurs along the two horizontal planes thereof $H_1$ and $H_2$.

The opposing latch/eject member 202 of the connector 10 which engages the other end 108 of the circuit card 100 (which does not contain a polarizing slot 112) is also provided with an eject surface 212 on its base portion 206 and an alignment surface 203 on its body portion 204. The alignment surface 203 is also arcuate in nature and likewise travels in an arc when the latch/eject member 202 is pivoted around its roll pin 38 when external pressure is applied to its actuating lever 210. By comparing the two ends 106, 108 of the circuit card 100 and their associated latch/eject members 200, 202, it can be seen that the arc length of the alignment surface 203 is less than that of the first latch/eject member 200.

Figure 5:
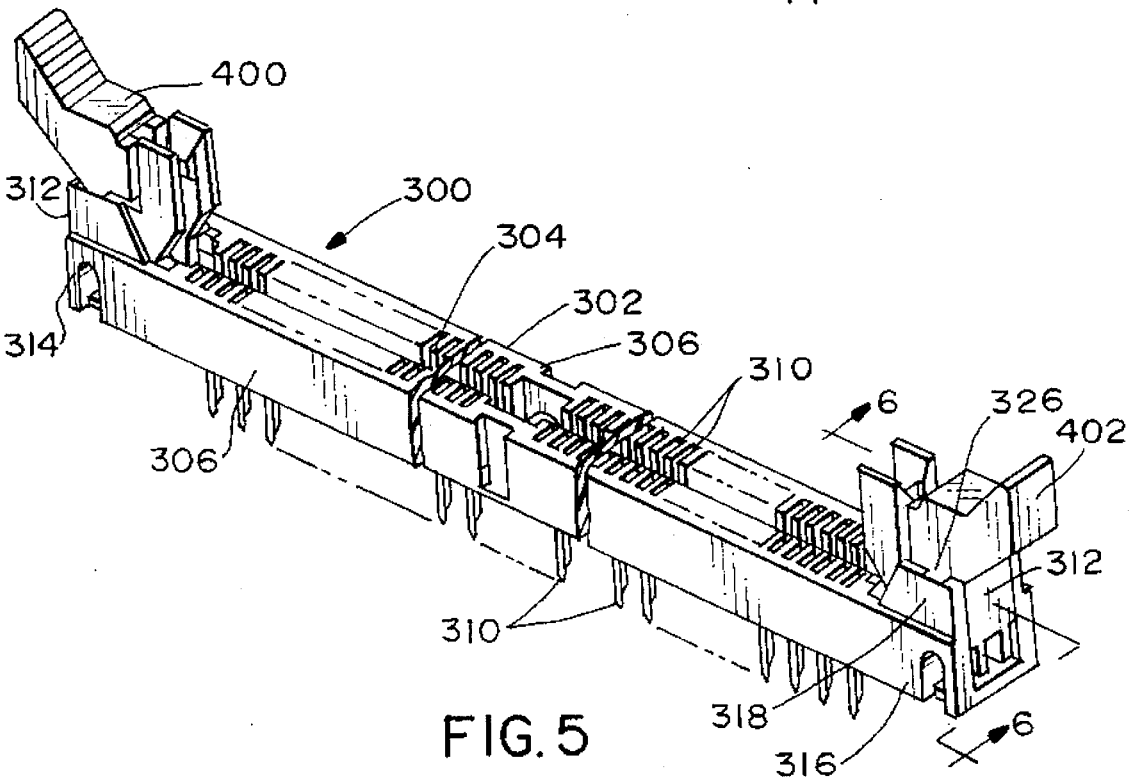
FIG. 5 is a perspective view of an alternate embodiment of an edge card connector constructed in accordance with the principals of the present invention.

FIG. 5 illustrates an alternate embodiment of a connector 300 constructed in accordance with the principles of the present invention in which roll pin 38 is eliminated. An elongated connector housing 302 is provided with a central circuit card slot 304 extending longitudinally therein between two opposing sidewalls 306. A plurality of contact-receiving cavities 308 are present in the connector sidewalls 306 in a predetermined spacing which receive a like number of electrical contacts 310 which extend through the bottom of the connector 300 as illustrated. The connector housing 302 further includes endwall openings 312 disposed at the ends 314, 316 of the connector 300 which permit latch/eject members 400, 402 to partially pivot therethrough. The sidewalls 306 of connector 300 include sidewall extensions 318 that extend upwardly at the connector ends 314, 316.

Figure 6:
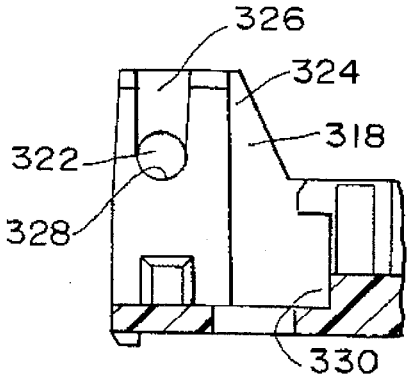
FIG. 6 is a sectional view of one end of the connector housing of FIG. 5 taken along lines 6—6 thereof.

The sidewall extensions 318 include openings 322 formed therein which receive round securement projections on the latches, as described below with respect to FIGS. 7–11. As illustrated in FIG. 6, the interior surfaces 324 of the sidewall extensions are provided with recesses 326 which extend down to and meet with the securement projection openings 322. The bottoms 328 of the recesses 326 provide a cradle which partially supports the securement projections 420. Such a construction is advantageous in injection molding in that it does not require any "side-pull" inserts during molding to form the securement projection openings 322 that extend sideways relative to the mold cavity, thereby reducing the overall cost of manufacturing the connectors 10.

Figure 7:
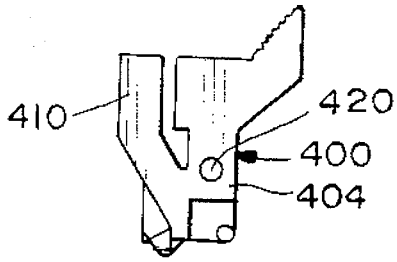
FIG. 7 is an elevational view of one of the two latch/eject members of the connector of FIG. 5.
Figure 8:
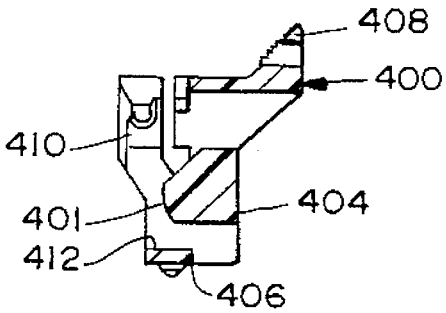
FIG. 8 is a sectional view of the latch/eject member of the connector of FIG. 5.

FIGS. 7 and 8 illustrate two latch/eject members 400, 402 which are used in conjunction with the connector 300. Each latch/eject member 400, 402 includes a body portion 404, a base portion 406 and an actuating portion 408. Two latch arms 410 extend away and upwardly from the body portion 404 and base portion 406 and are spaced apart to define a circuit card-receiving space therebetween. The base portion 406 includes an eject surface 412 which is received within a recess 330 of the connector end 314 and which contacts the lower edge of the circuit card 100.

The eject surface 412 is disposed beneath and spaced apart from the body portion 404, and particularly, the alignment surface 401 thereon. As seen in FIG. 8, this alignment surface 401 extends into the card-receiving space defined by the body and base portions 404, 406 and latch arms 410. The alignment surface 401 has an arcuate profile 416 which, in the instance of a partially circular profile, has its center of rotation coincident with the center of rotation of the securement projection 420. Securement projections 420 are molded integrally with and project from the sides of body portion 404. The alignment surface 401 is further dimensioned such that during insertion of the circuit card 100 into the card slot 304, the alignment surface is in contact or immediately adjacent with the end edges of the circuit card.

Figure 9:
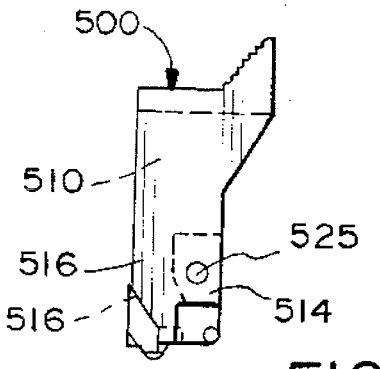
FIG. 9 is an elevational view of another latch/eject member suitable for use in the present invention.
Figure 10:
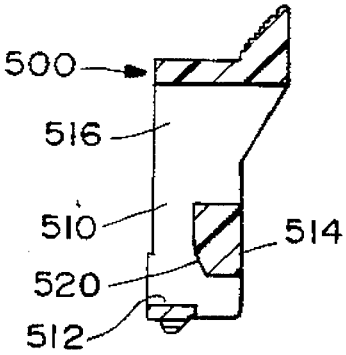
FIG. 10 is a sectional view of the latch/eject member of FIG. 9.
Figure 11:
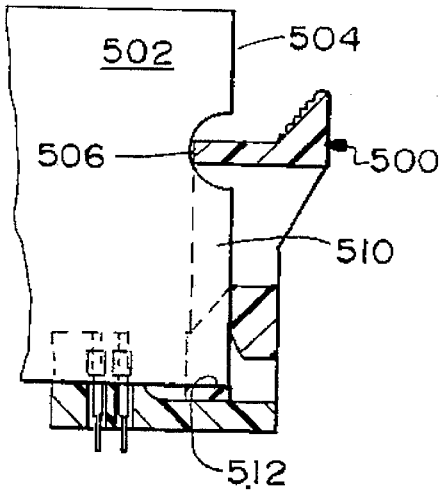
FIG. 11 is a sectional view of the latch/eject member of FIG. 9 in place within a connector housing in engagement with a circuit card.

FIGS. 9–11 illustrate a third embodiment of a latch/eject member 500 constructed in accordance with the principles of the present invention and particularly suitable for use with a circuit card of the "8-byte" style, wherein the circuit card 502 has two opposing ends 504 which each include a notch 506 disposed therein. In such a latch/eject member, resilient arms that engage the side of the circuit card may or may not be included. Regardless, a slot 510 is disposed in the latch/eject member 500 which extends up from the latch/eject member base portion 512 and upwardly along the body portion 514 between two sidewalls 516 thereof. The slot 510 terminates at an upper endwall 518 which forms a means to engage the circuit card notches 506.

As seen in FIGS. 10 and 11, the latch/eject member 500 includes an alignment surface 520 which is disposed between the sidewalls 516. This alignment surface 520 extends along the body portion 514 and defines an arcuate contour which, as mentioned above, is the locus of tangent points between the latch/eject member 500 and the end edges 505 of the circuit card 502 during the insertion movement. In the embodiment illustrated, the alignment surface 520 is defined by a radius of rotation having a center of rotation coincident with the center of the latch/eject member pivot projection 525.

Importantly, the incorporation of the alignment surfaces on the latch/eject members serves to align the circuit card (and its accompanying contact pads) with the appropriate contacts of the connector housing, thereby avoiding any misalignment problems. This alignment occurs throughout the entire step of insertion inasmuch as at least a portion of the arcuate alignment surface will always abut the opposing end edges of the circuit card during insertion, regardless of the orientation of the latch/eject members. This alignment occurs prior to the pads on circuit card touching the contacts of the connector, so that the card is guided prior to insertion to prevent misalignment and shorting of the contacts.

It will be appreciated that the embodiments of the present invention discussed herein are merely illustrative of a few applications of the principles of the invention. Numerous modifications may be made by those skilled in the art without departing from the true spirit and scope of the invention.

I claim:

1. An edge card connector for providing an electrical connection between a primary circuit member and a printed circuit card, the printed circuit card having a lower edge which extends between two opposing ends of said circuit card and which is insertable into and removable from the connector, said circuit card having a plurality of electrical contact pads disposed on at least one side thereof adjacent the circuit card lower edge, said connector comprising:

an elongated dielectric housing having an elongated card slot disposed therein and extending between two opposing end portions of said housing, the housing card slot having a predetermined longitudinal axis and being adapted to receive said card lower edge therein in an electrically operative relationship, said housing including a pair of opposing sidewalls extending generally parallel to the connector housing axis;

a plurality of contact terminals disposed in said housing, each contact terminal having a portion positioned in said card slot for slidingly engaging said circuit card upon insertion thereof into said housing card slot, said contact terminals contacting said circuit card pads at a contact area which lies within said housing card slot when said circuit card is inserted into said housing card slot;

at least one latch/eject member positioned at one end of said connector housing and pivotally mounted to said connector housing, said latch/eject member being movable between first and second operative positions, whereby in said first operative position said circuit card is positioned within said housing card slot, and whereby in said second operative position at least a portion of said circuit card is ejected from said housing card slot, said latch/eject member further having means for aligning said circuit card lower edge with said housing card slot such that said circuit card pads are properly aligned with said housing contact terminals regardless of the position of said latch/eject member, said latch/eject member further including means for ejecting said circuit card upon movement of said latch/eject member to said second operative position, including an eject arm spaced apart from said circuit card alignment means, the eject arm being adapted to engage said lower edge of said circuit card when said circuit card is inserted into said housing card slot, said circuit card alignment means including an alignment surface formed on said latch/eject member and opposing an end edge of said circuit card, the alignment surface pivoting in an arc when said latch/eject member is moved between said first and second operative positions, said alignment surface abutting said end edge of said circuit card for at least a portion of said arc during insertion of said circuit card into said housing card slot.

2. The edge card connector as defined in claim 1, wherein said latch/eject member alignment surface is partially circular.

3. The edge card connector as defined in claim 1, wherein said latch/eject member includes a body portion and said alignment surface includes an alignment lobe extending from said latch/eject member body portion towards said connector housing card slot.

4. The edge card connector as defined in claim 3, wherein said alignment surface includes a surface of partial revolution having a center which is coincident with the center of rotation of said latch/eject member.

5. The edge card connector as defined in claim 1, wherein said latch/eject member includes a body portion and a pair of latch arms for latching said circuit card in said housing card slot, the latch arms extending from said body portion and cooperating with said eject arm to define a card-receiving space within said latch/eject member, the eject arm defining a base portion of said card-receiving space.

6. The edge card connector as defined in claim 5, wherein said latch arms extend outwardly and upwardly from said latch/eject member body portion, said alignment surface projecting partially into said card-receiving space.

7. The edge card connector as defined in claim 5, wherein each of said latch arms are cantilevered and said latch arms further include two opposing, projecting engagement surfaces.

8. The edge card connector as defined in claim 5, wherein said alignment surface projects from said body portion partially into said latch/eject card-receiving space.

9. The edge card connector as defined in claim 1, further including a second latch/eject member pivotally mounted to a second end of said housing, the second latch/eject member also including an alignment surface disposed on a body portion thereof.

10. The edge card connector as defined in claim 9, wherein said second latch/eject member alignment surface has a length which is less than that of said latch/eject member alignment surface.

11. An edge card connector for providing an electrical connection between a primary circuit card and a printed circuit card, the circuit card having a lower edge which is insertable into and removable from the connector, said circuit card having a plurality of electrical contact pads disposed on at least one side thereof adjacent the circuit card lower edge, said circuit card pads being aligned in a first horizontal plane extending between opposing ends of said circuit card, said connector comprising:

an elongated housing having an elongated card slot disposed therein and extending between opposing first and second end portions of said housing, the card slot having a predetermined longitudinal axis and being adapted to receive said circuit card lower edge therein in an electrically conductive relationship, said housing including a pair of opposing sidewalls extending generally parallel to the housing axis;

a plurality of contact terminals disposed in said housing, each contact terminal having a contact portion positioned in said card slot for engaging said circuit card pads upon insertion thereof into said card slot, said contact portions being aligned in a second horizonal plane within said card slot which opposes said first horizontal plane when said circuit card is inserted into said card slot, said first and second horizontal planes defining a contact area which occurs within said housing slot between said housing contact terminals and said circuit card pads to thereby establish an electrically conductive relationship between said circuit card and said connector when said circuit card is inserted into said connector housing card slot;

first and second latch/eject members disposed at said respective first and second housing end portions, each of the latch/eject members being pivotally mounted to said housing so as to permit said latch/eject members to pivot partially around an axis of rotation between respective first and second operative positions, whereby in said first operative position, at least a portion of said circuit card is ejected from said card slot, and whereby in said second operative position, said latch/eject member retains said circuit card within said housing card slot;

each of said latch/eject members having a body portion, an ejection surface, and an alignment surface for aligning said circuit card pads with respect to said contact portions within housing card slot during insertion thereof, the alignment surface being spaced apart from said ejection surface such that said housing and circuit card contact area lies between said latch/eject member ejection and alignment surfaces when said circuit card is fully inserted into said card slot, said alignment surfaces of said first and second latch/eject members further having arcuate contours which define two opposing surfaces of partial revolution which contact opposing ends of said circuit card during insertion and which maintain said circuit card in a predetermined alignment with said card slot during insertion regardless of the position of said latch/eject members.

12. The edge card connector as defined in claim 11, wherein each of said two latch/eject members includes a base portion extending beneath said body portion thereof to define card-receiving spaces of said latch/eject member, said ejection surfaces being disposed on said base portions, said housing further including a pair recesses aligned with said card slot and disposed at opposite ends thereof, said recesses receiving said latch/eject member base portions when said latch/eject members are in said second operative position.

13. The edge card connector as defined in claim 11, wherein said latch/eject members include a pair of latching arms extending upwardly to define card-receiving spaces in cooperation with said body portions and ejection surfaces thereof, at least one latching arm including a projection which is adapted to latchingly engage an opening of said circuit board.

14. The edge card connector as defined in claim 11, wherein said latch/eject member body portions include a vertical slot aligned with said base portions thereof, said alignment surfaces being disposed within said slots, said body portions further including latching members disposed transverse to said slot and adapted to engage opening in said circuit opposing ends.

15. The edge card connector as defined in claim 11, wherein said first latch/eject member alignment surface includes an alignment lobe which extends from said first latch/eject member body portion toward said card slot.

16. The edge card connector as defined in claim 15 wherein said first latch/eject member alignment surface arcuate contour is defined by a locus of tangent points having a common center disposed at a center of pivoting said first latch/eject member.

17. The edge card connector as defined in claim 11, wherein each of said latch/eject members includes a vertical slot which receives a portion of said circuit card when said circuit card is inserted into said card slot, said slot having an end portion defined by a transverse member which is adapted to engage an opening on said circuit card and to retain said circuit card in place within said housing card slot.

18. The edge card connector as defined in claim 17, wherein said latch/eject member alignment surfaces are disposed within said latch/eject member slots.

19. An edge card connector for providing an electrical connection between a primary circuit card and a printed circuit card, the circuit card having a lower edge extending between first and second ends of said circuit card, said circuit card lower edge being insertable into and removable from the connector, said circuit card having a plurality of electrical contact pads disposed on at least one side thereof adjacent the circuit card lower edge, said connector comprising:

an elongated housing having an elongated card slot disposed therein and extending between opposing first and second end portions of said housing, the card slot having a predetermined longitudinal axis and being adapted to receive said circuit card lower edge therein in an electrically conductive relationship, said housing including a pair of opposing sidewalls extending generally parallel to the housing axis;

a plurality of contact terminals disposed in said housing, each contact terminal having a contact portion positioned in said card slot for engaging said circuit card pads upon insertion thereof into said card slot, said contact portions being positioned within said card slot such that said contact portions and said circuit card pads oppose each other to thereby establish an electrically conductive relationship between said circuit card and said connector when said circuit card is inserted into said connector housing card slot;

first and second latch/eject members disposed at said respective first and second housing end portions, said first and second latch/eject members being pivotally mounted to said housing by respective securement members which permit them to pivot between respective first and second operative positions, whereby in said first operative position at least a portion of said circuit card is ejected from said card slot, and whereby in said second operative position, said circuit card is retained within said housing card slot;

each of said first and second latch/eject members having a body portion, an ejection surface, and an alignment surface for aligning said circuit card pads with respect to said contact portions within housing card slot during insertion thereof by contacting said circuit card first and second ends, the alignment surface, being spaced apart from said ejection surface, said alignment surfaces of said first and second latch/eject members further having arcuate contours defined by a locus of tangent points between said alignment surfaces and respective ones of said circuit card first and second edges to maintain said circuit card in a predetermined alignment with said card slot during insertion regardless of the position of said latch/eject members.

20. The edge card connector as defined in claim 19, wherein said first latch/eject member alignment surface arcuate contour has a length which is greater than said second latch/eject member alignment surface.

* * * * *